US009892696B2

(12) United States Patent
Yang et al.

(10) Patent No.: US 9,892,696 B2
(45) Date of Patent: Feb. 13, 2018

(54) DISPLAY PANEL HAVING A PLURALITY OF PIXELS DRIVEN IN A TIME-SHARING MANNER, DISPLAY METHOD THEREOF AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Kai Yang, Beijing (CN); Xue Dong, Beijing (CN); Hao Zhang, Beijing (CN); Lingyun Shi, Beijing (CN); Renwei Guo, Beijing (CN); Peng Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 253 days.

(21) Appl. No.: 14/765,990

(22) PCT Filed: Sep. 29, 2014

(86) PCT No.: PCT/CN2014/087765
§ 371 (c)(1),
(2) Date: Aug. 5, 2015

(87) PCT Pub. No.: WO2015/176463
PCT Pub. Date: Nov. 26, 2015

(65) Prior Publication Data

US 2016/0293120 A1 Oct. 6, 2016

(30) Foreign Application Priority Data

May 19, 2014 (CN) ..... 2014 1 0211444

(51) Int. Cl.
*G09G 5/00* (2006.01)
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/3655* (2013.01);
(Continued)

(58) Field of Classification Search
None
See application file for complete search history.

(56) References Cited

U.S. PATENT DOCUMENTS

2003/0218618 A1* 11/2003 Phan ..... G09G 3/2074 345/629
2011/0140999 A1* 6/2011 Beland ..... G06F 3/1446 345/82

FOREIGN PATENT DOCUMENTS

CN 1779510 A 5/2006
CN 101276109 A 10/2008
(Continued)

OTHER PUBLICATIONS

The First Office Action dated Dec. 7, 2015 corresponding to Chinese application No. 201410211444.X.
(Continued)

*Primary Examiner* — William Boddie
*Assistant Examiner* — David Lee
(74) *Attorney, Agent, or Firm* — Nath, Goldberg & Meyer; Joshua B. Goldberg

(57) ABSTRACT

The present invention provides a display panel, a display method thereof and a display device. The display panel comprises multiple pixel units arranged in a matrix, three sub-pixels having different colors in each pixel unit form a first pixel, four sub-pixels in the middle of any two adjacent pixel units in the same row comprise three sub-pixels having different colors that form a second pixel, four sub-pixels in
(Continued)

the middle of any two adjacent pixel units in the same column comprise three sub-pixels having different colors that form a third pixel, and four sub-pixels in the middle of any four pixel units in adjacent two rows and adjacent two columns comprise three sub-pixels having different colors that form a fourth pixel, wherein within display time of one frame of image, the first pixel, second pixel, third pixel and fourth pixel are displayed in a time-sharing manner.

18 Claims, 8 Drawing Sheets

(52) U.S. Cl.
CPC ..... *G09G 2300/0443* (2013.01); *G09G 2300/0452* (2013.01); *G09G 2310/08* (2013.01); *G09G 2320/0242* (2013.01); *G09G 2340/0457* (2013.01)

(56) References Cited

FOREIGN PATENT DOCUMENTS

| | | | |
|---|---|---|---|
| CN | 101655637 | A | 2/2010 |
| CN | 202736924 | U | 2/2013 |
| CN | 102998834 | A | 3/2013 |
| CN | 103278960 | A | 9/2013 |
| CN | 103714751 | A | 4/2014 |
| CN | 104050896 | A | 9/2014 |
| JP | 2005091875 | A | 4/2005 |

OTHER PUBLICATIONS

International Search Report dated Sep. 29, 2014 corresponding to International application No. PCT/CN2014/087765.

* cited by examiner

DISPLAY PANEL HAVING A PLURALITY OF PIXELS DRIVEN IN A TIME-SHARING MANNER, DISPLAY METHOD THEREOF AND DISPLAY DEVICE

FIELD OF THE INVENTION

The present invention relates to the field of display technology, and particularly relates to a display panel, a display method thereof and a display device.

BACKGROUND OF THE INVENTION

Liquid crystal displays, due to their thinness, lightweight and energy saving, have been widely used in modern information devices.

A display panel of a liquid crystal display generally includes a plurality of pixel units. As shown in FIG. 1, each pixel unit is formed by three sub-pixels (i.e., red sub-pixel 101, green sub-pixel 102 and blue sub-pixel 103), and the three sub-pixels are arranged in a line. During display, the red sub-pixel 101, the green sub-pixel 102 and the blue sub-pixel 103 emit red light, green light and blue light with different brightness, respectively, and light of the three colors are mixed to generate light of any desired color.

An improved resolution is usually achieved in a conventional display panel by way of decreasing size of a sub-pixel and a gap between sub-pixels. However, when the resolution reaches a certain degree, demand for manufacturing process becomes higher and higher, the foregoing way of improving resolution will hit a bottleneck, and as a result, the resolution of the display panel cannot be further improved.

SUMMARY OF THE INVENTION

In view of the above technical problems existing in the prior art, the present invention provides a display panel, a display method thereof and a display device. In the display panel, first pixels, second pixels, third pixels and fourth pixels are formed by sharing sub-pixels in the pixel units, and are driven within display time of one frame of image in a time-sharing manner, and thus image display with high resolution can be achieved without adding the number of the pixel units, thereby improving display effect.

The present invention provides a display panel, which comprises a plurality of pixel units arranged in a matrix, each pixel unit comprises a red sub-pixel, a green sub-pixel, a blue sub-pixel and a X sub-pixel, the X sub-pixel being any one of a red sub-pixel, a green sub-pixel and a blue sub-pixel, wherein, three sub-pixels having different colors in each pixel unit form a first pixel, four sub-pixels in the middle of any two adjacent pixel units in the same row include three sub-pixels having different colors that form a second pixel, four sub-pixels in the middle of any two adjacent pixel units in the same column include three sub-pixels having different colors that form a third pixel, and four sub-pixels in the middle of any four pixel units in adjacent two rows and adjacent two columns include three sub-pixels having different colors that form a fourth pixel; and within display time of one frame of image, the first pixel, the second pixel, the third pixel and the fourth pixel are driven in a time-sharing manner.

Preferably, the red sub-pixel, the green sub-pixel, the blue sub-pixel and the X sub-pixel in each pixel unit are arranged in a sub-matrix having two rows and two columns, the rows of the sub-matrix are aligned and the columns thereof are aligned.

Preferably, in each pixel unit, the X sub-pixel and the sub-pixel having the same color as the X sub-pixel are arranged in a diagonal of the sub-matrix; and the plurality of pixel units are of the same structure.

Alternatively, in each pixel unit, the X sub-pixel and the sub-pixel having the same color as the X sub-pixel are arranged in a diagonal of the sub-matrix; and the X sub-pixels in any two adjacent pixel units in the same row or in the same column have different colors.

Alternatively, in each pixel unit, the X sub-pixel and the sub-pixel having the same color as the X sub-pixel are arranged in the same row of the sub-matrix; and the pixel units in the same column are of the same structure, and the X sub-pixels in any two adjacent pixel units in the same row have different colors.

Alternatively, in each pixel unit, the X sub-pixel and the sub-pixel having the same color as the X sub-pixel are arranged in the same row of the sub-matrix; and the pixel units in the same row are of the same structure, and the X sub-pixels in any two adjacent pixel units in the same column have different colors.

Preferably, the first pixel, the second pixel, the third pixel and the fourth pixel have equal display time.

The present invention further provides a display method of a display panel, the display panel comprises a plurality of pixel units arranged in a matrix, each pixel unit comprises a red sub-pixel, a green sub-pixel, a blue sub-pixel and a X sub-pixel, the X sub-pixel being any one of a red sub-pixel, a sub-pixel and a blue sub-pixel, wherein, three sub-pixels having different colors in each pixel unit form a first pixel, three sub-pixels, which form a second pixel, having different colors are included in four sub-pixels in the middle of any two adjacent pixel units in the same row, three sub-pixels, which form a third pixel, having different colors are included in four sub-pixels in the middle of any two adjacent pixel units in the same column, and three sub-pixels, which form a fourth pixel, having different colors are included in four sub-pixels in the middle of any four pixel units in adjacent two rows and adjacent two columns; and the display method includes: driving, within display time of one frame of image, the first pixel, the second pixel, the third pixel and the fourth pixel in a time-sharing manner.

Preferably, the first pixel, the second pixel, the third pixel and the fourth pixel have equal display time.

The present invention further provides a display device, which comprising the above display panel.

Beneficial effects of the present invention are as follows: in the display panel provided by the present invention, three sub-pixels having different colors in each pixel unit form the first pixel, three sub-pixels having different colors in four sub-pixels in the middle of any two adjacent pixel units in the same row form the second pixel, three sub-pixels having different colors in four sub-pixels in the middle of any two adjacent pixel units in the same column form the third pixel, and three sub-pixels having different colors in four sub-pixels in the middle of any four pixel units in adjacent two rows and adjacent two columns form the fourth pixel; and the first pixel, the second pixel, the third pixel and the fourth pixel are driven within display time of one frame of image in a time-sharing manner. Therefore, some sub-pixel(s) in each pixel unit can be shared, thus the number of sub-pixels in the display panel can be decreased and the manufacturing cost of the display panel can be lowered; moreover, image resolution is improved, thereby improving display effect of the display panel. In summary, the display panel can achieve high resolution image display and improve display effect without increasing the number of the sub-pixels.

The display device provided by the present invention not also has relatively low manufacturing cost, but can also achieve relatively high image resolution and good display effect.

DETAILED DESCRIPTION OF THE EMBODIMENTS

To enable those skilled in the art to better understand the technical solutions of the present invention, a display panel, a display method thereof and a display device are further described in detail below in conjunction with the accompanying drawings and specific implementations.

Embodiment 1

Figure 2:
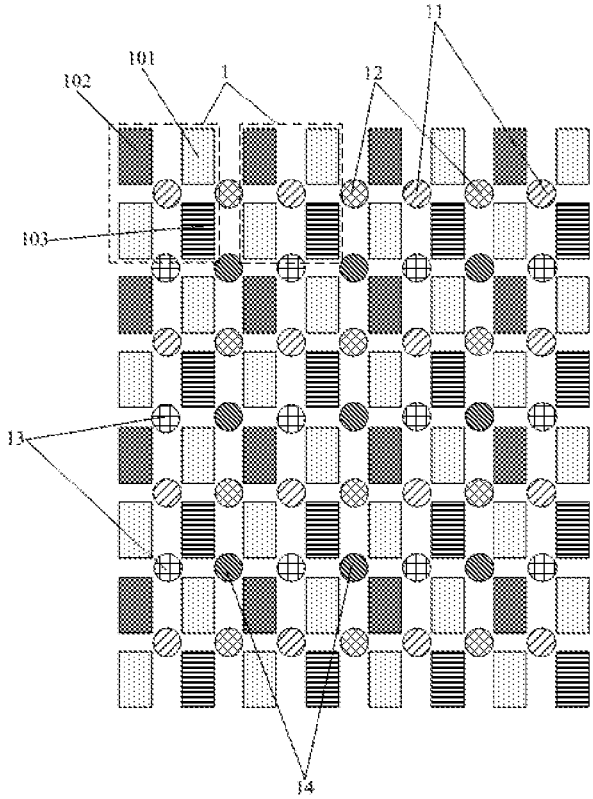
FIG. 2 is a schematic diagram of a structure of a display panel provided by Embodiment 1 of the present invention.

This embodiment provides a display panel, which, as shown in FIG. 2, comprises a plurality of pixel units 1 arranged in a matrix, and each pixel unit 1 comprises a red sub-pixel 101, a green sub-pixel 102, a blue sub-pixel 103 and a X sub-pixel. The X sub-pixel is any one of a red sub-pixel 101, a green sub-pixel 102 and a blue sub-pixel 103. Three sub-pixels having different colors in each pixel unit form a first pixel, four sub-pixels in the middle of any two adjacent pixel units in the same row includes three sub-pixels having different colors that form a second pixel, four sub-pixels in the middle of any two adjacent pixel units in the same column include three sub-pixels having different colors that form a third pixel, and four sub-pixels in the middle of any four pixel units in adjacent two rows and adjacent two columns include three sub-pixels having different colors that form a fourth pixel.

Generally, one red sub-pixel 101, one green sub-pixel 102 and one blue sub-pixel 103 can form one pixel. For example, in this embodiment, the red sub-pixel 101, the green sub-pixel 102 and the blue sub-pixel 103 in each pixel unit 1 are able to form the first pixel 11. The red sub-pixel 101, the green sub-pixel 102 and the blue sub-pixel 103 in the four sub-pixels in the middle of any two adjacent pixel units 1 in the same row are able to form the second pixel 12. The red sub-pixel 101, the green sub-pixel 102 and the blue sub-pixel 103 in the four sub-pixels in the middle of any two adjacent pixel units 1 in the same column are able to form the third pixel 13. The red sub-pixel 101, the green sub-pixel 102 and the blue sub-pixel 103 in the four sub-pixels in the middle of any four pixel units 1 in adjacent two rows and adjacent two columns are able to form the fourth pixel 14. Furthermore, within display time of one frame of image, the first pixel 11, the second pixel 12, the third pixel 13 and the fourth pixel 14 are driven in a time-sharing manner. It can be understood that, in the plurality of pixel units 1 arranged in a matrix, pixel units 1 in each row of the matrix are aligned, and pixel units 1 in each column are also aligned.

Figure 3:
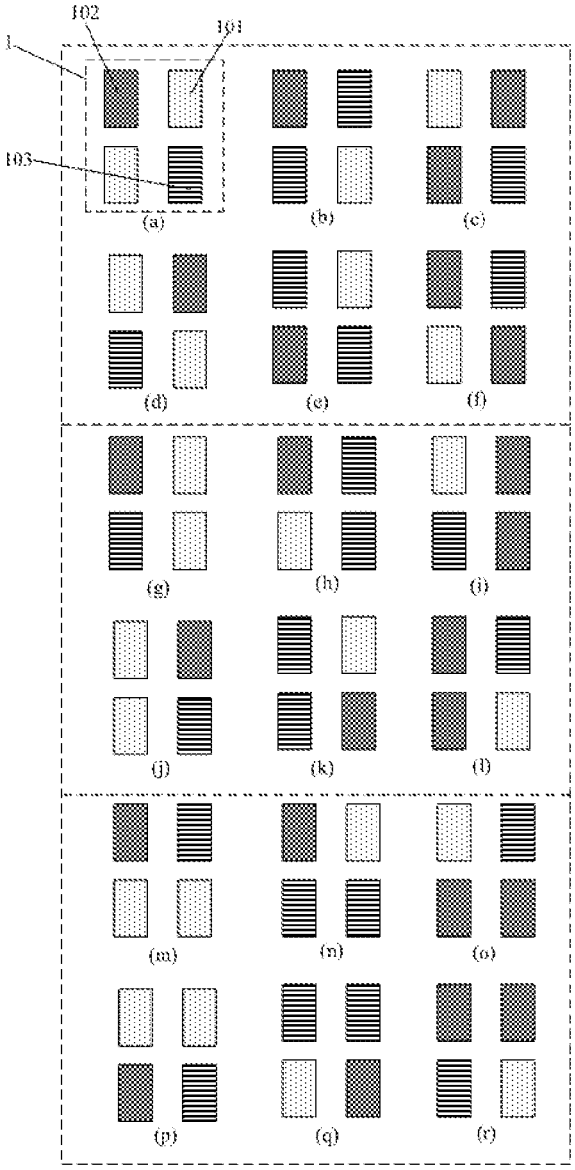
FIG. 3 a schematic diagram of a structure of a pixel unit in a display panel provided by the present invention.

Furthermore, as shown in (a)-(r) of FIG. 3, the red sub-pixel 101, the green sub-pixel 102, the blue sub-pixel 103 and the X sub-pixel 104 in each pixel unit 1 arranged in a matrix are specifically arranged in a sub-matrix having two rows and two columns, and in the sub-matrix, the rows are aligned and the columns are aligned.

In addition, it should be noted that, one or more from the red, green and blue sub-pixels included in the second pixel 12, the third pixel 13 or the fourth pixel 14 may be X sub-pixels, as long as each of the second pixel 12, the third pixel 13 and the fourth pixel 14 includes three different colors of sub-pixels (i.e., red sub-pixel, green sub-pixel and blue sub-pixel).

In each pixel unit 1, the X sub-pixel and the sub-pixel having the same color as the X sub-pixel may be arranged in a diagonal of the sub-matrix, as shown in (a)-(f) of FIG. 3. Specifically, the sub-matrix has two diagonals, the X sub-pixel and the sub-pixel having the same color as the X sub-pixel may be arranged in either one of the diagonals, the remaining two sub-pixels may be arranged in the other diagonal, and positions of the remaining two sub-pixels are exchangeable.

The display panel provided by this embodiment may include a pixel unit matrix formed by arranging any one of the pixel units 1 shown in (a)-(f) of FIG. 3. For example, in each pixel unit 1, X sub-pixel is a red sub-pixel, and the X sub-pixel and the red sub-pixel 101 are arranged in one diagonal of the sub-matrix.

For example, the display panel provided by this embodiment may include a pixel unit matrix formed by arranging the pixel unit 1 shown in (a) of FIG. 3. Specifically, the display panel may include 16 pixel units 1 (in four rows and four columns), i.e., 64 sub-pixels (in eight rows and eight columns), as shown in FIG. 2.

Figure 4:
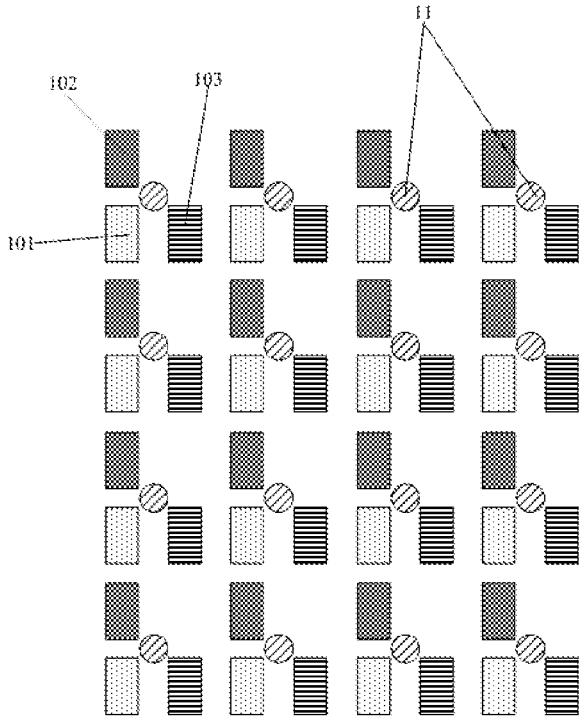
FIG. 4 is a schematic diagram of sub-pixels of pixel units that need to be driven when displaying first pixels in FIG. 2.

FIG. 4 is a schematic diagram of sub-pixels forming the pixel units 1 that need to be driven when displaying the first pixels 11. As shown in FIG. 4, when driving each of the first pixels 11, it only needs to drive three sub-pixels (namely, the red sub-pixel 101 or X sub-pixel, the green sub-pixel 102 and the blue sub-pixel 103) in each pixel unit 1. By driving all of the first pixels 11, a part of one frame of image corresponding thereto can be displayed.

Figure 5:
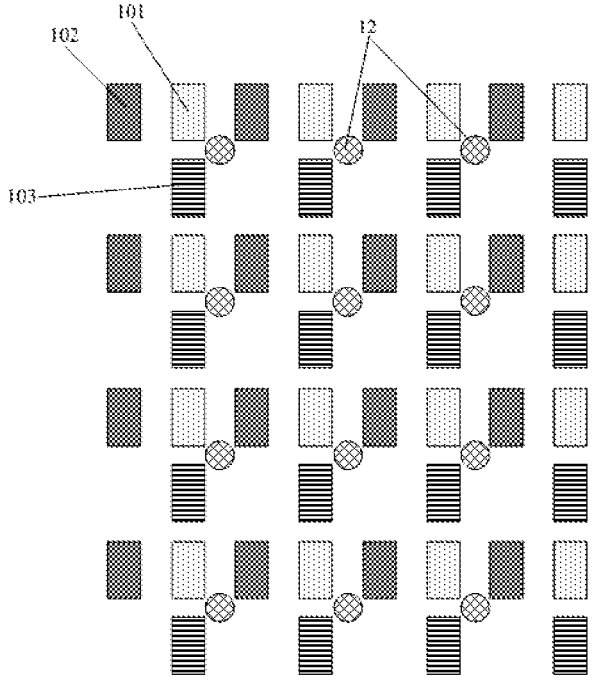
FIG. 5 is a schematic diagram of sub-pixels of pixel units that need to be driven when displaying second pixels in FIG. 2.

FIG. 5 is a schematic diagram of sub-pixels forming the pixel units 1 that need to be driven when displaying the second pixels 12. As shown in FIG. 5, when driving each of the second pixels 12, also, it only needs to drive three sub-pixels, i.e., the red sub-pixel 101 (or X sub-pixel), the green sub-pixel 102 and the blue sub-pixel 103 in the four sub-pixels in the middle of two adjacent pixel units 1 in the same row. For example, in FIG. 5, two sub-pixels (i.e., the red sub-pixel 101 and the blue sub-pixel 103) in the former pixel unit 1 and one sub-pixel (i.e., the green sub-pixel 102) in the latter pixel unit 1 are driven. By driving all of the second pixels 12, a part of one frame of image corresponding thereto can be displayed.

Figure 6:
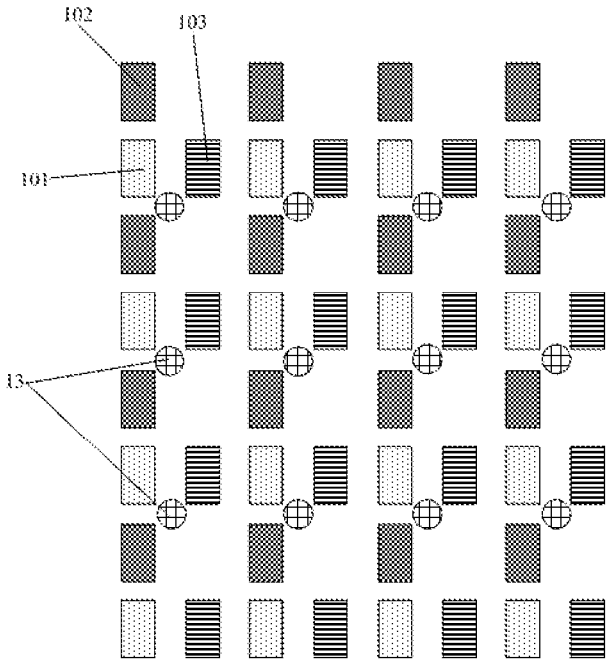
FIG. 6 is a schematic diagram of sub-pixels of pixel units that need to be driven when displaying third pixels in FIG. 2.

FIG. 6 is a schematic diagram of sub-pixels forming the pixel units 1 that need to be driven when displaying the third pixels 13. When driving each of the third pixels 13, also, it only needs to drive three sub-pixels, i.e., the red sub-pixel 101 (or X sub-pixel), the green sub-pixel 102 and the blue sub-pixel 103 in the four sub-pixels in the middle of two adjacent pixel units 1 in the same column. For example, in FIG. 6, two sub-pixels (i.e., the red sub-pixel 101 and the blue sub-pixel 103) in the upper pixel unit 1 and one sub-pixel (i.e., the green sub-pixel 102) in the lower pixel unit 1 are driven. By driving all of the third pixels 13, a part of one frame of image corresponding thereto can be displayed.

Figure 7:
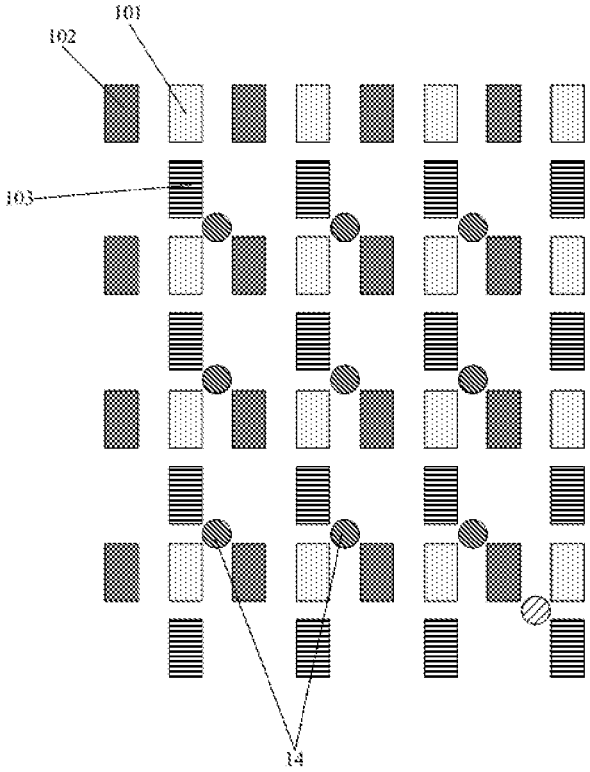
FIG. 7 is a schematic diagram of sub-pixels of pixel units that need to be driven when displaying fourth pixels in FIG. 2.

FIG. 7 is a schematic diagram of sub-pixels forming the pixel units 1 that need to be driven when displaying the fourth pixels 14. As shown in FIG. 7, when driving each of the fourth pixels 14, also, it only needs to drive three sub-pixels, i.e., the red sub-pixel 101 (or X sub-pixel), the green sub-pixel 102 and the blue sub-pixel 103 in the four sub-pixels in the middle of four pixel units 1 in adjacent two rows and adjacent two columns. For example, in FIG. 7, one sub-pixel (i.e., the blue sub-pixel 103) in the former pixel unit 1 in the upper row, one sub-pixel (i.e., the red sub-pixel 101) in the former pixel unit 1 in the lower row, and one sub-pixel (i.e., the green sub-pixel 102) in the latter pixel unit 1 in the lower row are driven. By driving all of the fourth pixels 14, a part of one frame of image corresponding thereto can be displayed. So far, display of the frame of image is completed.

From the above description of driving the sub-pixels when driving the pixels to display one frame of image, it can be seen that, some sub-pixel(s) in adjacent pixel units 1 can be shared, thus the number of the sub-pixels in a display panel can be reduced, thereby lowering process cost. In addition, when displaying the first pixels 11, the second pixels 12, the third pixels 13 and the fourth pixels 14, respectively, since the sub-pixels forming the respective pixels are distributed evenly and in order, the display panel provided by this embodiment achieves more uniform display and better display effect.

In general, time for displaying one frame of image is equal to the time period of persistence of vision of human eyes. That is, during display, refresh rates of images displayed by the first pixels 11, the second pixels 12, the third pixels 13 and the fourth pixels 14 are higher than resolving power of human eyes, and therefore, human eyes will treat the images displayed by the first pixels 11, the second pixels 12, the third pixels 13 and the fourth pixels 14 as one frame of image, thereby improving resolution of said one frame of image.

Figure 1:
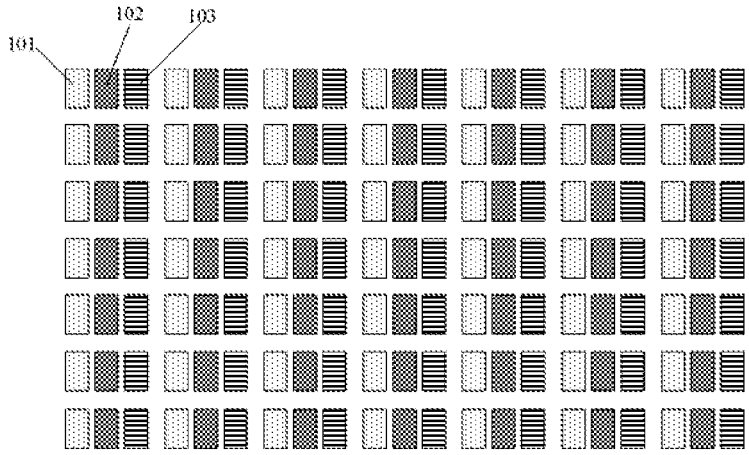
FIG. 1 is a schematic diagram of a structure of a display panel in the prior art.

Taking the display panel including 16 pixel units 1 as shown in FIG. 2 as an example, in the display panel, the 64 sub-pixels in the 16 pixel units 1 may form 49 (7×7) pixels successively (i.e., the first pixels 11, the second pixels 12, the third pixels 13 and the fourth pixels 14 in FIG. 2) by sharing some sub-pixel(s) in each pixel unit. In other words, one frame of image is displayed through 49 pixels. In the conventional display panel shown in FIG. 1, in order to display one frame of image of 49 pixels, 147 (49×3) sub-pixels need to be provided in the display panel. Therefore, the display panel provided by the present invention can achieve higher resolution display by using fewer sub-pixels, and improve the display effect thereof to be more than two times that of the conventional display panel. In addition, compared to the traditional display panel, the number of the sub-pixels in the display panel provided by this embodiment is decreased, and thus process difficulty in manufacturing the display panel is lowered.

The above display panel provided by the present invention can achieve a higher resolution and improve display effect, without adding sub-pixels.

Preferably, the first pixels 11, the second pixels 12, the third pixels 13 and the fourth pixels 14 have equal display time. As such, parts of the image respectively displayed by the first pixels 11, the second pixels 12, the third pixels 13 and the fourth pixels 14 have equal time period of persistence in human eyes, which can ensure that one frame of image synthesized by human eyes has no obvious deficiency or defect, and thus display quality of images is ensured.

It should be noted that, although this embodiment is described by taking a case in which the X sub-pixel is a red sub-pixel as an example, the X sub-pixel may be a green sub-pixel or a blue sub-pixel.

Figure 8:
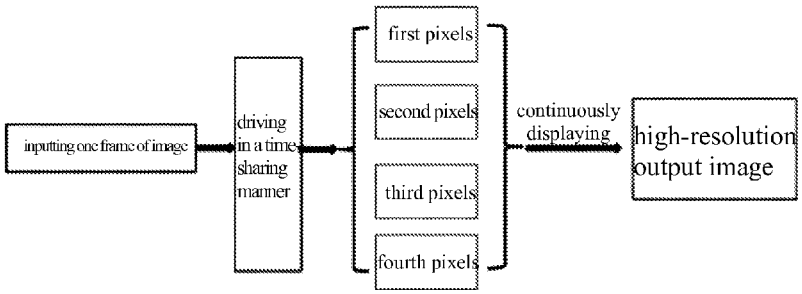
FIG. 8 is a schematic diagram of a display method of the display panel in FIG. 2.

This embodiment also provides a display method of the above display panel, which, as shown in FIG. 8, includes: driving, within display time of one frame of image, the first pixel, the second pixel, the third pixel and the fourth pixel in a time-sharing manner.

As described above, time for displaying one frame of image is generally equal to the time period of persistence of vision of human eyes. That is, during display, refresh rates of images displayed by the first pixels 11, the second pixels 12, the third pixels 13 and the fourth pixels 14 are all higher than resolving power of human eyes, and therefore, human eyes will treat the images displayed by the first pixels 11, the second pixels 12, the third pixels 13 and the fourth pixels 14 as one frame of image, thereby improving resolution of said one frame of image.

Preferably, the first pixels 11, the second pixels 12, the third pixels 13 and the fourth pixels 14 have equal display time, and in the display time of one frame of image, the first pixels 11, the second pixels 12, the third pixels 13 and the fourth pixels 14 are driven in turn. As such, parts of the image respectively displayed by the first pixels 11, the second pixels 12, the third pixels 13 and the fourth pixels 14 have equal time period of persistence in human eyes, which can ensure that one frame of image synthesized by human eyes has no obvious deficiency or defect, and thus display quality of images is ensured.

Embodiment 2

This embodiment provides a display panel, which differs from that in Embodiment 1 in that, in each pixel unit 1, the X sub-pixel and the sub-pixel having the same color as the X sub-pixel are arranged in the same row of the sub-matrix, as shown in (m)-(r) of FIG. 3.

As shown in (m)-(r) of FIG. 3, each sub-matrix comprises two rows, the X sub-pixel and the sub-pixel having the same color as the X sub-pixel may be arranged in either one row, the remaining two sub-pixels may be arranged in the other row, and the positions of the remaining two sub-pixels may be exchanged.

The display panel provided by this embodiment may include a pixel unit matrix formed by arranging any one of the pixel units 1 shown in (m)-(r) of FIG. 3.

Other structures of the display panel provided by this embodiment and the display method thereof are the same as those in Embodiment 1, and are not repeated herein.

Embodiment 3

This embodiment provides a display panel, which differs from those in Embodiments 1 and 2 in that, in each pixel unit 1, the X sub-pixel and the sub-pixel having the same color as the X sub-pixel are arranged in the same column of the sub-matrix, as shown in (g)-(l) of FIG. 3.

As shown in (g)-(l) of FIG. 3, each sub-matrix comprises two columns, the X sub-pixel and the sub-pixel having the same color as the X sub-pixel may be arranged in either one column, the remaining two sub-pixels may be arranged in the other column, and the positions of the remaining two sub-pixels may be exchanged.

The display panel provided by this embodiment may include a pixel unit matrix formed by arranging any one of the pixel units 1 shown in (g)-(l) of FIG. 3.

Other structures of the display panel provided by this embodiment and the display method thereof are the same as those in either one of Embodiments 1 and 2, and are not repeated herein.

Embodiment 4

This embodiment provides a display panel, which differs from those in Embodiments 1 to 3 in that, the X sub-pixels in any two adjacent pixel units 1 in the same row or in the same column have different colors, the X sub-pixels in the two adjacent pixel units 1 are any two of a red sub-pixel, a green sub-pixel and a blue sub-pixel, respectively, and in each pixel unit 1, the X sub-pixel and the sub-pixel having the same color as the X sub-pixel are arranged in a diagonal of the sub-matrix.

Figure 9:
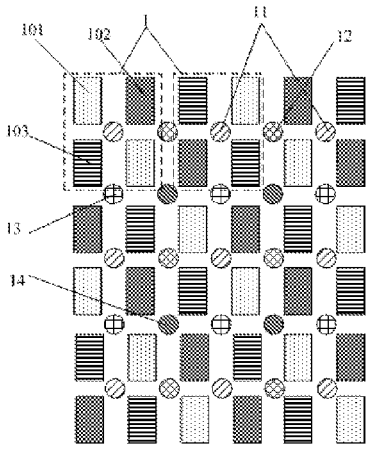
FIG. 9 is a schematic diagram of a structure of a display panel provided by Embodiment 4 of the present invention.

The display panel provided by this embodiment may include a pixel unit matrix formed by arranging the pixel units 1 shown in (d), (e) and (f) of FIG. 3 in turn. Specifically, the display panel may include nine pixel units 1 (in three rows and three columns), i.e., 36 (6×6) sub-pixels, as shown in FIG. 9.

Figure 10:
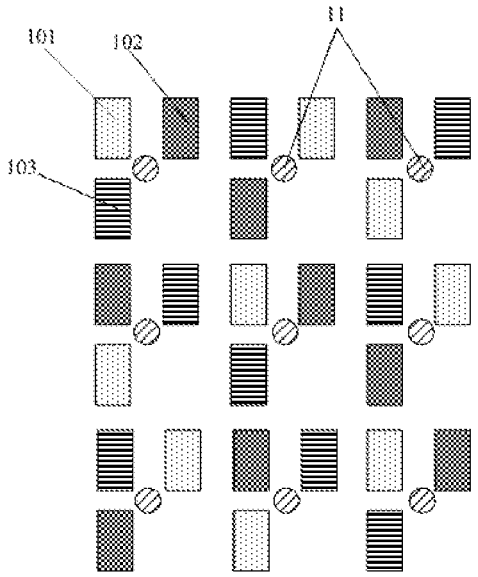
FIG. 10 is a schematic diagram of sub-pixels of pixel units that need to be driven when displaying first pixels in FIG. 9.

FIG. 10 is a schematic diagram of sub-pixels forming the pixel units 1 that need to be driven to display the first pixels 11. As shown in FIG. 10, when driving each of the first pixels 11, it only needs to drive three sub-pixels (namely, the red sub-pixel 101 (or X sub-pixel), the green sub-pixel 102 and the blue sub-pixel 103) in each pixel unit 1. By driving all of the first pixels 11, a part of one frame of image corresponding thereto can be displayed.

Figure 11:
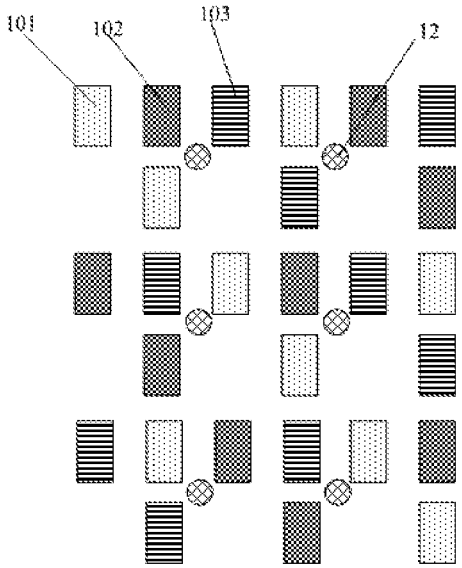
FIG. 11 is a schematic diagram of sub-pixels of pixel units that need to be driven when displaying second pixels in FIG. 9.

FIG. 11 is a schematic diagram of sub-pixels forming the pixel units 1 that need to be driven to display the second pixels 12. As shown in FIG. 11, when driving each of the second pixels 12, also, it only needs to drive three sub-pixels, i.e., the red sub-pixel 101, the green sub-pixel 102 and the blue sub-pixel 103 in the four sub-pixels in the middle of two adjacent pixel units 1 in the same row are driven. For example, in FIG. 11, two sub-pixels in the former pixel unit 1 and one sub-pixel in the latter pixel unit 1 are driven. By driving all of the second pixels 12, a part of one frame of image corresponding thereto can be displayed.

Figure 12:
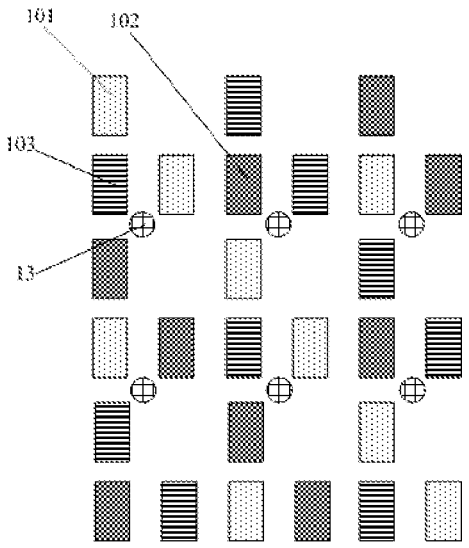
FIG. 12 is a schematic diagram of sub-pixels of pixel units that need to be driven when displaying third pixels in FIG. 9.

FIG. 12 is a schematic diagram of sub-pixels forming the pixel units 1 that need to be driven to display the third pixels 13. As shown in FIG. 12, when driving each of the third pixels 13, also, it only needs to drive three sub-pixels, i.e., the red sub-pixel 101 (or X sub-pixel), the green sub-pixel 102 and the blue sub-pixel 103 in the four sub-pixels in the middle of two adjacent pixel units 1 in the same column are driven. For example, in FIG. 12, two sub-pixels in the upper pixel unit 1 and one sub-pixel in the lower pixel unit 1 are driven. By driving all of the third pixels 13, a part of one frame of image corresponding thereto can be displayed.

Figure 13:
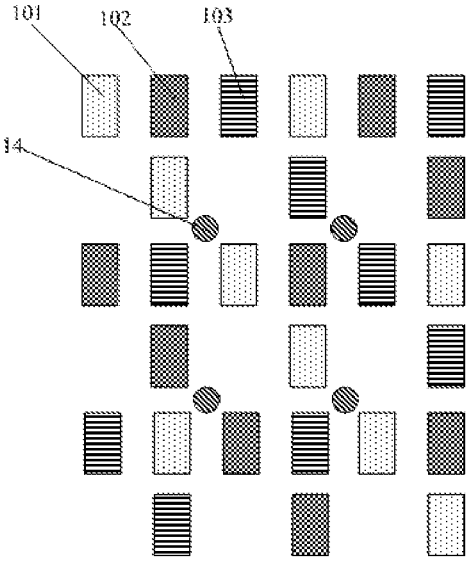
FIG. 13 is a schematic diagram of sub-pixels of pixel units that need to be driven when displaying fourth pixels in FIG. 9.

FIG. 13 is a schematic diagram of sub-pixels forming the pixel units 1 that need to be driven to display the fourth pixels 14. As shown in FIG. 13, when driving each of the fourth pixels 14, also, it only needs to drive three sub-pixels, i.e., the red sub-pixel 101 (or X sub-pixel), the green sub-pixel 102 and the blue sub-pixel 103 in the four sub-pixels in the middle of four pixel units 1 in adjacent two rows and adjacent two columns are driven. For example, in FIG. 13, one sub-pixel in the former pixel unit 1 in the upper row, one sub-pixel in the former pixel unit 1 in the lower row, and one sub-pixel in the latter pixel unit 1 in the lower row are driven. By driving all of the fourth pixels 14, a part of one frame of image corresponding thereto can be displayed. So far, display of the frame of image is completed.

Other structures of the display panel provided by this embodiment and the display method thereof are the same as those in any one of Embodiments 1 to 3, and are not repeated herein.

Embodiment 5

This embodiment provides a display panel, which differs from those in Embodiments 1 to 4 in that, the pixel units 1 in the same column are of the same structure, the X sub-pixels in any two adjacent pixel units 1 in the same row have different colors, the X sub-pixels in the two adjacent pixel units 1 are any two of a red sub-pixel, a green sub-pixel and a blue sub-pixel, respectively, and in each pixel unit 1, the X sub-pixel and the sub-pixel having the same color as the X sub-pixel are arranged in the same row of the sub-matrix.

Figure 14:
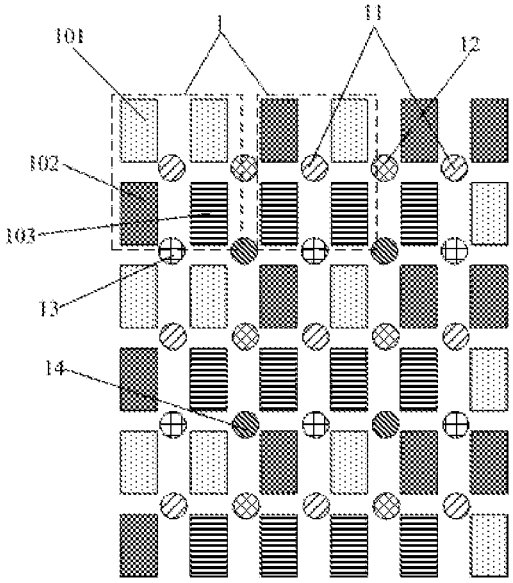
FIG. 14 is a schematic diagram of a structure of a display panel provided by Embodiment 5 of the present invention.

The display panel provided by this embodiment may include a pixel unit matrix formed by arranging the pixel units 1 shown in (p), (n) and (r) of FIG. 3. Specifically, as shown in FIG. 14, the display panel may comprises nine pixel units 1 (in three rows and three columns), i.e., 36 (6×6) sub-pixels.

Other structures of the display panel provided by this embodiment and the display method thereof are the same as those in any one of Embodiments 1 to 4, and are not repeated herein.

Embodiment 6

This embodiment provides a display panel, which differs from those in Embodiments 1 to 5 in that, the pixel units 1 in the same row are of the same structure, the X sub-pixels in any two adjacent pixel units 1 in the same column have different colors, the X sub-pixels in the two adjacent pixel units 1 are any two of a red sub-pixel, a green sub-pixel and a blue sub-pixel, respectively, and in each pixel unit 1, the X sub-pixel and the sub-pixel having the same color as the X sub-pixel are arranged in the same column of the sub-matrix.

Figure 15:
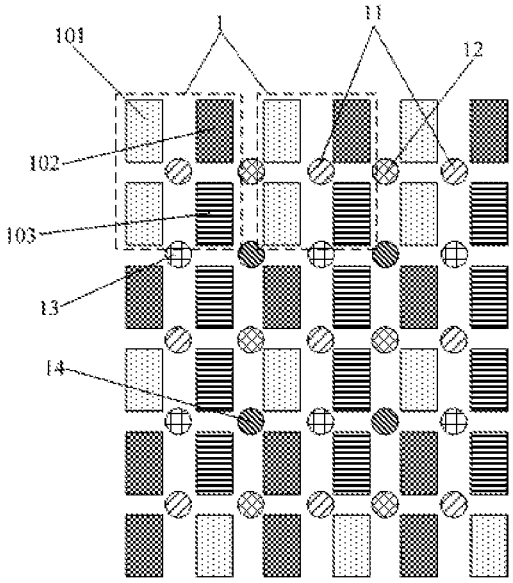
FIG. 15 is a schematic diagram of a structure of a display panel provided by Embodiment 6 of the present invention.

The display panel provided by this embodiment may include a pixel unit matrix formed by arranging the pixel units 1 shown in (j), (h) and (l) of FIG. 3. Specifically, as shown in FIG. 15, the display panel may comprises nine pixel units 1 (in three rows and three columns), i.e., 36 (6×6) sub-pixels.

Other structures of the display panel provided by this embodiment and the display method thereof are the same as those in any one of Embodiments 1 to 5, and are not repeated herein.

Beneficial effects achieved by Embodiments 1 to 6 are as follows: in the display panels provided by Embodiments 1 to 6, three sub-pixels having different colors (the red sub-pixel, the green sub-pixel and the blue sub-pixel) in each pixel unit form the first pixel, three sub-pixels having different colors in four sub-pixels in the middle of any two adjacent pixel units in the same row form the second pixel, three sub-pixels having different colors in four sub-pixels in the middle of any two adjacent pixel units in the same column form the third pixel, and three sub-pixels having different colors in four sub-pixels in the middle of any four pixel units in adjacent two rows and adjacent two columns form the fourth pixel; and meanwhile the first pixels, the second pixels, the third pixels and the fourth pixels are driven within display time of one frame of image in a time-sharing manner. Therefore, some sub-pixel(s) in each pixel unit can be shared, thus the number of sub-pixels in the display panel can be decreased and the manufacturing cost of the display panel can be lowered; moreover, image resolution is improved, thereby improving display effect of the display panel. In summary, the display panel can achieve high resolution image display and improve display effect, without adding pixel units.

It should be noted that, the first pixels 11, the second pixels 12, the third pixels 13 and the fourth pixels 14 shown in the drawings are merely schematically illustrates the distribution of the formed pixels, rather than representing the pixels. Furthermore, those skilled in the art should understand that, in the present invention, pixel units and pixels are not in a one-to-one correspondence, the number of pixels formed by the pixel units may be far larger than that of the pixel units by sharing the sub-pixels in the pixel units, for example, as shown in FIG. 2, 16 pixel units may form 49 pixels, and for another example, as shown in FIGS. 9, 14 and 15, nine pixel units may form 25 pixels.

In addition, although only the above embodiments have been described in the present invention, those skilled in the art should understand that the present invention is not limited to the above embodiments, but covers any display panel in which the first pixels 11, the second pixels 12, the third pixels 13 and the fourth pixels 14 all include three different colors of sub-pixels.

Embodiment 7

This embodiment provides a display device, which comprises the display panel in any one of Embodiments 1 to 6.

The display device provided by this embodiment not also has relatively low manufacturing cost, but can also achieve relatively high image resolution and relatively good display effect.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A display panel, comprising a plurality of pixel units arranged in a matrix, each pixel unit comprises a red sub-pixel, a green sub-pixel, a blue sub-pixel and a X sub-pixel, the X sub-pixel being any one of a red sub-pixel, a green sub-pixel and a blue sub-pixel, wherein, three sub-pixels having different colors in each pixel unit form a first pixel, four sub-pixels in the middle of any two adjacent pixel units in the same row comprise three sub-pixels having different colors that form a second pixel, four sub-pixels in the middle of any two adjacent pixel units in the same column comprise three sub-pixels having different colors that form a third pixel, and four sub-pixels in the middle of any four pixel units in adjacent two rows and adjacent two columns comprise three sub-pixels having different colors that form a fourth pixel;

within display time of one frame of image, the first pixel, the second pixel, the third pixel and the fourth pixel are driven in a time-sharing manner;

the red sub-pixel, the green sub-pixel, the blue sub-pixel and the X sub-pixel in each pixel unit are arranged in a sub-matrix with two rows and two columns, the rows of the sub-matrix are aligned and the columns thereof are aligned;

in each pixel unit, the X sub-pixel and the sub-pixel having the same color as the X sub-pixel are arranged in a diagonal of the sub-matrix; and the X sub-pixels in any two adjacent pixel units in the same row or in the same column have different colors.

2. The display panel according to claim 1, wherein, the first pixel, the second pixel, the third pixel and the fourth pixel have equal display time.

3. A display method of a display panel, wherein the display panel is the display panel according to claim 1; and the display method comprises: driving, within display time of one frame of image, the first pixel, the second pixel, the third pixel and the fourth pixel in a time-sharing manner.

4. The display method according to claim 3, wherein, the first pixel, the second pixel, the third pixel and the fourth pixel have equal display time.

5. A display device, comprising the display panel according to claim 1.

6. The display device according to claim 5, wherein, the first pixel, the second pixel, the third pixel and the fourth pixel have equal display time.

7. A display panel, comprising a plurality of pixel units arranged in a matrix, each pixel unit comprises a red sub-pixel, a green sub-pixel, a blue sub-pixel and a X sub-pixel, the X sub-pixel being any one of a red sub-pixel, a green sub-pixel and a blue sub-pixel, wherein, three sub-pixels having different colors in each pixel unit form a first pixel, four sub-pixels in the middle of any two adjacent pixel units in the same row comprise three sub-pixels having different colors that form a second pixel, four sub-pixels in the middle of any two adjacent pixel units in the same column comprise three sub-pixels having different colors that form a third pixel, and four sub-pixels in the middle of any four pixel units in adjacent two rows and adjacent two columns comprise three sub-pixels having different colors that form a fourth pixel; and within display time of one frame of image, the first pixel, the second pixel, the third pixel and the fourth pixel are driven in a time-sharing manner, wherein the red sub-pixel, the green sub-pixel, the blue sub-pixel and the X sub-pixel in each pixel unit are arranged in a sub-matrix with two rows and two columns, the rows of the sub-matrix are aligned and the columns thereof are aligned, wherein, in each pixel unit, the X sub-pixel and the sub-pixel having the same color as the X sub-pixel are arranged in the same row of the sub-matrix; and in the pixel units in the same column, the red sub-pixel, the green sub-pixel, the blue sub-pixel and the X sub-pixel are arranged in a same manner, and the X sub-pixels in any two adjacent pixel units in the same row have different colors.

8. The display panel according to claim 7, wherein, the first pixel, the second pixel, the third pixel and the fourth pixel have equal display time.

9. A display device, comprising the display panel according to claim 7.

10. The display device according to claim 9, wherein, the first pixel, the second pixel, the third pixel and the fourth pixel have equal display time.

11. A display method of a display panel, wherein the display panel is the display panel according to claim 7; and the display method comprises: driving, within display time of one frame of image, the first pixel, the second pixel, the third pixel and the fourth pixel in a time-sharing manner.

12. The display method according to claim 11, wherein, the first pixel, the second pixel, the third pixel and the fourth pixel have equal display time.

13. A display panel, comprising a plurality of pixel units arranged in a matrix, each pixel unit comprises a red sub-pixel, a green sub-pixel, a blue sub-pixel and a X sub-pixel, the X sub-pixel being any one of a red sub-pixel, a green sub-pixel and a blue sub-pixel, wherein, three sub-pixels having different colors in each pixel unit form a first pixel, four sub-pixels in the middle of any two adjacent pixel units in the same row comprise three sub-pixels having different colors that form a second pixel, four sub-pixels in the middle of any two adjacent pixel units in the same column comprise three sub-pixels having different colors that form a third pixel, and four sub-pixels in the middle of any four pixel units in adjacent two rows and adjacent two columns comprise three sub-pixels having different colors that form a fourth pixel; and within display time of one frame of image, the first pixel, the second pixel, the third pixel and the fourth pixel are driven in a time-sharing manner, wherein the red sub-pixel, the green sub-pixel, the blue sub-pixel and the X sub-pixel in each pixel unit are arranged in a sub-matrix with two rows and two columns, the rows of the sub-matrix are aligned and the columns thereof are aligned, and wherein, in each pixel unit, the X sub-pixel and the sub-pixel having the same color as the X sub-pixel are arranged in the same column of the sub-matrix; and in the pixel units in the same row, the red sub-pixel, the green sub-pixel, the blue sub-pixel and the X sub-pixel are arranged in a same manner, and the X sub-pixels in any two adjacent pixel units in the same column have different colors.

14. The display panel according to claim 13, wherein, the first pixel, the second pixel, the third pixel and the fourth pixel have equal display time.

15. A display device, comprising the display panel according to claim 13.

16. The display device according to claim 15, wherein, the first pixel, the second pixel, the third pixel and the fourth pixel have equal display time.

17. A display method of a display panel, wherein the display panel is the display panel according to claim 13; and the display method comprises: driving, within display time of one frame of image, the first pixel, the second pixel, the third pixel and the fourth pixel in a time-sharing manner.

18. The display method according to claim 17, wherein, the first pixel, the second pixel, the third pixel and the fourth pixel have equal display time.

* * * * *